US005727957A

United States Patent [19]

Hashimoto et al.

[11] Patent Number: 5,727,957

[45] Date of Patent: Mar. 17, 1998

[54] SURFACE MOUNT CONNECTOR

[75] Inventors: Shinichi Hashimoto; Yoshitsugu Fujiura, both of Tokyo, Japan

[73] Assignee: The Whitaker Corporation, Wilmington, Del.

[21] Appl. No.: 780,766

[22] Filed: Jan. 8, 1997

Related U.S. Application Data

[63] Continuation of Ser. No. 516,770, Aug. 17, 1995, abandoned.

[30] Foreign Application Priority Data

Oct. 20, 1994 [JP] Japan ..... 6-281344

[51] Int. Cl.[6] ..... H01R 9/09

[52] U.S. Cl. ..... 439/79; 439/733.1; 439/83

[58] Field of Search ..... 439/79, 59, 629, 439/62, 78, 80, 81, 82, 83, 733.1

[56] References Cited

U.S. PATENT DOCUMENTS

| | | | |
|---|---|---|---|
| 4,210,376 | 7/1980 | Hughes et al. | 339/17 LC |
| 4,410,230 | 10/1983 | SanMiguel | 339/176 M |
| 4,425,015 | 1/1984 | Rizzo | 339/17 LC |
| 4,550,962 | 11/1985 | Czeschka | 339/17 LC |
| 4,639,056 | 1/1987 | Lindeman et al. | 439/79 |
| 4,715,820 | 12/1987 | Andrews, Jr. et al. | 439/79 |
| 4,802,860 | 2/1989 | Kikuta | 439/79 |
| 4,815,982 | 3/1989 | Sadigh-Behzadi | 439/79 |
| 4,842,528 | 6/1989 | Frantz | 439/80 |
| 5,037,334 | 8/1991 | Viselli et al. | 439/733 |
| 5,071,372 | 12/1991 | Viselli et al. | 439/733 |
| 5,080,596 | 1/1992 | Viselli et al. | 439/79 |
| 5,085,601 | 2/1992 | Buchter et al. | 439/79 |
| 5,096,428 | 3/1992 | Lwee et al. | 439/79 |
| 5,122,078 | 6/1992 | Davis et al. | 439/405 |
| 5,145,383 | 9/1992 | Bowen et al. | 439/79 |
| 5,194,017 | 3/1993 | Consoli | 439/492 |
| 5,199,886 | 4/1993 | Patterson | 439/79 |
| 5,266,038 | 11/1993 | Nakamura | 439/79 |
| 5,316,489 | 5/1994 | Kachlic et al. | 439/70 |
| 5,346,404 | 9/1994 | Shimada | 439/108 |
| 5,547,384 | 8/1996 | Benjamin | 439/79 |

FOREIGN PATENT DOCUMENTS

| | | | |
|---|---|---|---|
| 0395577 | 9/1990 | European Pat. Off. | 439/83 |
| 7-272803 | 10/1995 | Japan . | |

OTHER PUBLICATIONS

European Search Report from EP Application No. 95 38 7450 mailed Sep. 3, 1997 (two pages).

*Primary Examiner*—Gary F. Paumen
*Assistant Examiner*—Tho Dac Ta
*Attorney, Agent, or Firm*—Anton P. Ness

[57] ABSTRACT

An electrical connector 10 has electrical contacts 30*a*, 30*b* arranged in cavities 40*a*, 40*b* of a housing 50. Electrical contacts 30*a*, 30*b* include contact sections 31 and termination sections 32*a*, 32*b* having plate sections 36 oriented perpendicular to a surface of the contact sections 31 and soldering termination members 37. When electrical contacts 30*a*, 30*b* are placed in the housing 50, a rear portion 34 of the contact section 31 can be bent due to the fact that cut-outs 47*a*, 47*b* corresponding to the rear portion 34 are provided in the inside walls of cavities 40*a*, 40*b*, thus allowing for elastic deformation of the rear portion 34. In addition, plate sections 36 have lugs 38 accommodated in grooves 55 formed in the housing 50. Because of resilience of the rear sections 34, the lugs 38 engage against bottom surfaces 56 of the grooves 55, thus determining the position of the soldering termination members 37.

10 Claims, 4 Drawing Sheets

SURFACE MOUNT CONNECTOR

This application is a Continuation of application Ser. No. 08/516,770 filed Aug. 17, 1995, now abandoned.

FIELD OF THE INVENTION

This invention relates to surface mount electrical connectors intended for soldering via surface mounting to printed circuit boards (PCB) or other circuit boards and equipped with multiple electrical contacts for electrical connection to circuits formed on such boards and to electrical contacts used in such connectors.

BACKGROUND OF THE INVENTION

Various types of electrical connectors intended for mounting on printed circuit boards having contacts designed for being electrically connected to contact pads formed on the surface of the boards, are known. An example of such an electrical connector is disclosed in Japanese Patent Application 94-62949. These electrical connectors comprise a number of electrical contacts having at one end a contact section intended for making electrical contact with a mating electrical contact and a termination section at its opposite end intended for soldering to the contact pads on the board, and a housing having cavities retaining the contacts in such a manner that the termination sections are arranged in a straight line. The plate forming the contact section and the termination section is oriented generally in one direction. The connection of the electrical connector to the circuit board is carried out by applying soldering cream having a consistency of a gel and made of solder flux to the contact pads on the circuit board, after which the termination sections of the electrical contacts are pressed against corresponding contact pads and heated thereby effecting electrical connections between the contact pads and the termination sections.

However, as a result of variations in the gaps between the inside walls of the cavities and the electrical contacts due to tolerance in dimensions and inconsistencies in assembly, variation in coplanarity of the termination sections of the electrical contacts also takes place. As a result of such variation in the positioning of the termination sections, there is a danger that some termination sections fail to form an electrical engagement with their respective pads when the termination sections are not against the board, thereby resulting in faulty soldering connections.

In order to solve the above-mentioned problem, in the electrical connector disclosed in Japanese Patent Application 94-62949, bosses are provided at least on one of the inside walls of the cavities. When such bosses engage with a surfaces of the electrical contacts, they deflect the contacts so that their opposite surfaces engage with the bosses made on the opposite inside walls of the cavity. This makes it possible to reduce variation in the position of the termination sections and to achieve an acceptable coplanarity of the soldering termination sections.

Another method which can be used for the elimination of variation in the position of the termination sections includes providing bosses on the surfaces of the electrical contacts by means of embossing. When electrical contacts with bosses are inserted in the housing cavities, the bosses are pressed against one inside wall of the cavities and the opposite sides of the contacts are pressed against the opposite wall, thus making it possible to control the variation.

However, electrical connectors of this type are not well suited for the trends related to the reduction in size of electric and electronic devices or to the increase in the density of circuitry patterns on the printed circuit board which requires reduction in contact pitch, that is in the reduction of the distance between the contacts. In some connectors, termination sections arranged at such a narrow pitch are supposed to make contact with the contact pads on a printed circuit board by engaging them perpendicularly. But since there is no appropriate means for the elimination of the variation in the position of the termination sections relative to the contact pads, there is a possibility of defective connections occurring during the soldering operation.

SUMMARY OF THE INVENTION

This invention is realized by the fact that in a surface mount connector which comprises an insulating housing having a number of cavities arranged in at least one row and electrical contacts inserted and retained in the cavities of the insulating housing, the electrical contacts have a contact section intended for electrical engagement with contacts of a matable connector, a plate section is arranged perpendicular to the contact section having a soldering termination section, and a lug is located at one edge of the plate section intended for disposition within inside walls of the cavities of the insulating housing.

This invention is also directed to an electrical contact for use in electrical connectors intended for surface mounting onto a circuit board which comprises a contact section intended for electrical engagement with a contact of a matable connector and a termination section intended for soldering to the circuit board, the contact section extends in a longitudinal direction, the termination section is part of a plate section perpendicular to the contact section, with both sections being a flat plate; and at an end of the plate section, the soldering termination section is located; and at an edge of the plate section a lug is located.

The electrical connectors according to this invention comprise a number of electrical contacts having termination sections intended for the soldering to contact pads on a surface of a printed circuit board and a housing accommodating the electrical contacts.

Electrical contacts of the present invention are made by stamping them from a metal sheet with subsequent bending, and at one end they each have a contact section intended for electrical engagement with a matable contact, and at the other end, a termination section. The termination section is bent at the back end of the contact section so that it is perpendicular to the plane of the contact section. Both the contact section and the termination section extend in a longitudinal direction. In the middle of the termination section, a plate section with a lug is provided, and at the back end of the termination section, a soldering termination member is located.

The electrical contacts are placed in cavities in a housing. This makes it possible to arrange the contact sections and the termination sections at appropriate pitches. In addition, recesses are provided in the housing adjacent to the back ends of the contact sections, in order to receive termination sections at the back ends of the contact sections in one direction. A number of grooves are provided in the housing opposite to the mating face. Plate sections of the electrical contacts are inserted in the grooves and lugs thereof engage a bottom surface of the grooves. Due to the engaging of the lugs with the bottom surfaces, the position of the soldering termination sections remain unchanged even when the back ends of the contact sections are urged in a direction opposite to that of the termination sections.

BRIEF DESCRIPTION OF THE DRAWINGS

An embodiment of the invention will now be described by way of example with reference to the accompanying drawings in which:

FIG. 3 is a side view of FIG. 1.

DETAILED DESCRIPTION OF THE INVENTION

Figures 1, 2, 7:
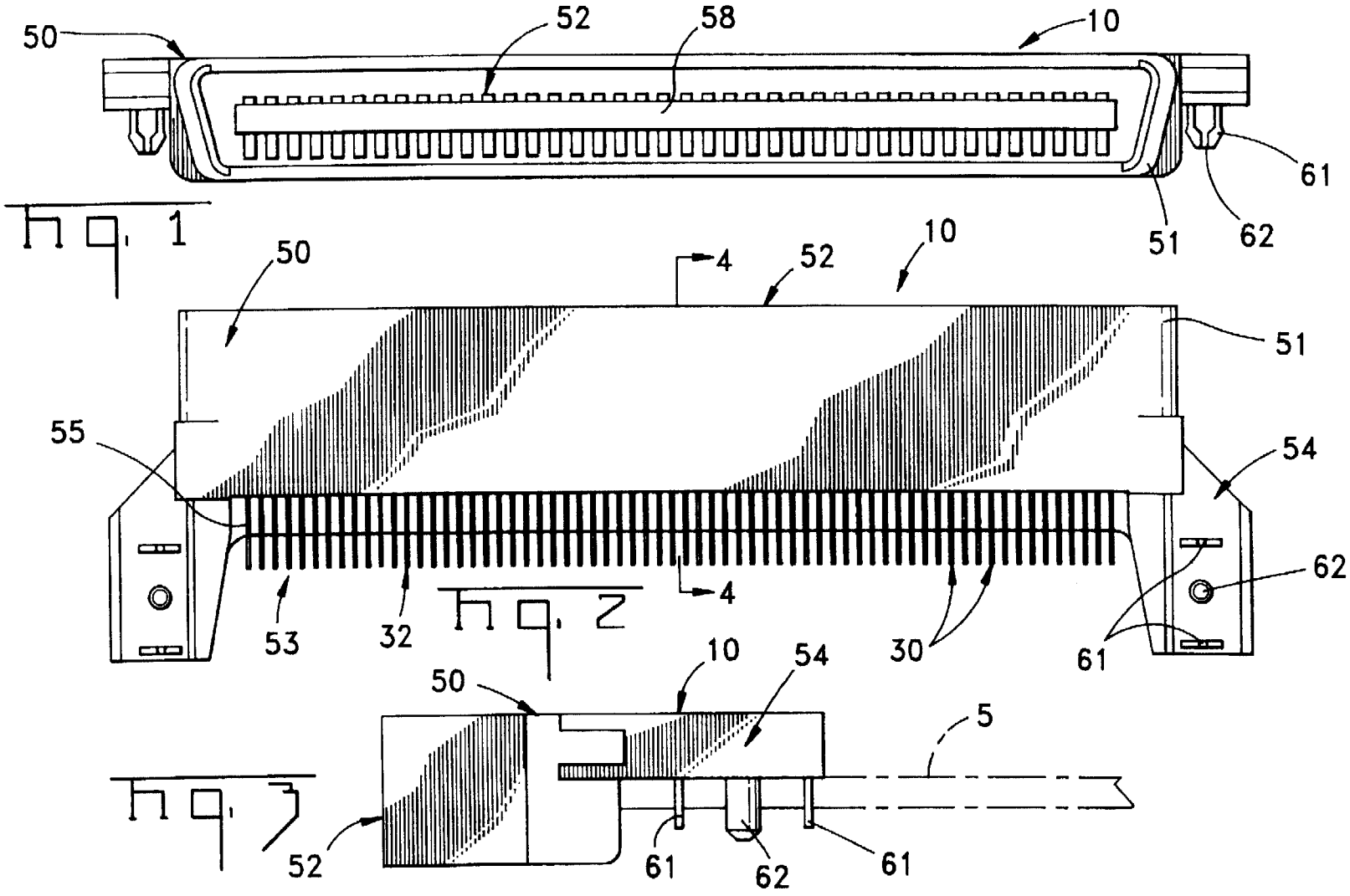
FIG. 1 is a front view of an electrical connector according to the invention.
FIG. 2 is a bottom view of FIG. 1.
FIG. 7 is a plan view of a carrier strip containing one type of electrical contacts used in the connector of FIG. 1.

FIG. 1 and FIG. 2 depict an electrical connector in the form of a surface mount connector and electrical contacts according to this invention. As it is shown in FIG. 1, the electrical connector 10 has multiple electrical contacts 30 arranged in a housing 50. The housing 50 comprises a mating face 52 having a shroud 51 and a connecting section 53 to connect it to a printed circuit board via termination sections 32 of electrical contacts 30. Explanations concerning the electrical contacts 30 are set forth below. The housing 50 comprises a board-mounting section 54 having mounting legs 61 and posts 62. The board-mounting section 54 extends from the sides of the housing 50 backwards, that is, in the direction of the connecting section 53. The position of the printed circuit board 5 is shown schematically in FIG. 3. Mounting legs 61 and posts 62 of the board-mounting section 54 are engaged in holes (not shown in the drawing) provided in the printed circuit board 5, thus securing the electrical connector 10 on the board 5.

Figure 9:
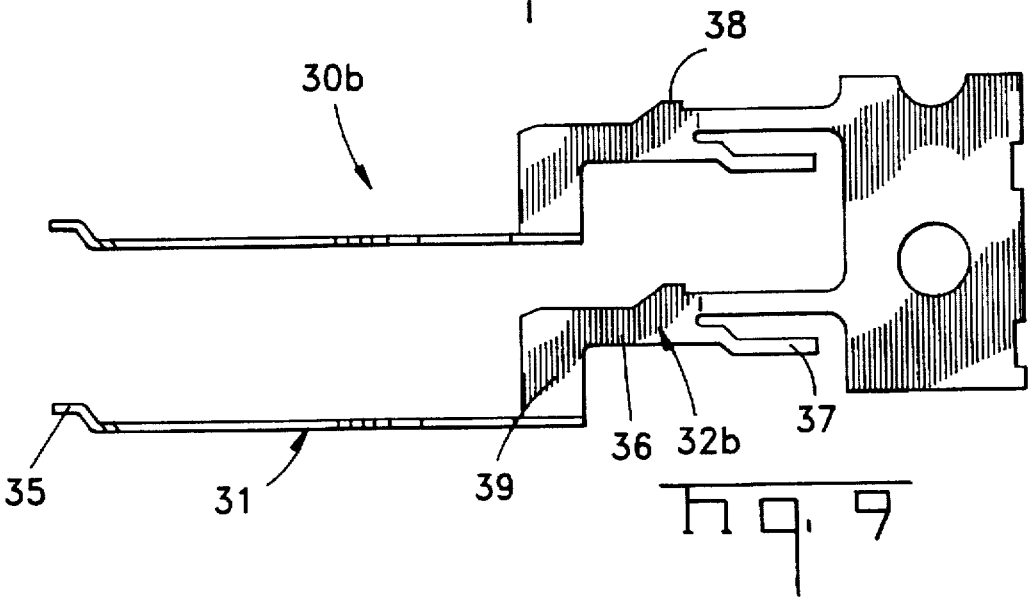
FIG. 9 is a plan view of a carried strip containing another type of electrical contacts used in the connector of FIG. 1 and similar to the electrical contacts shown in FIG. 7.
Figure 10:
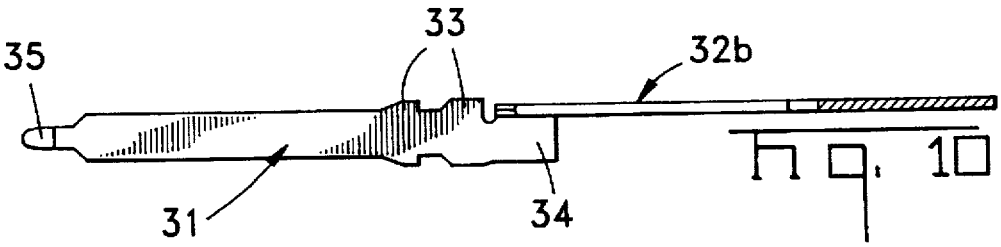
FIG. 10 is a partly-sectioned top view of FIG. 9.

Electrical contacts 30 are in the form of two types of electrical contacts **30*a* and 30*b* shown respectively in FIGS. 7 and 9. Both electrical contacts 30*a* and 30*b* have a contact section 31 and termination sections 32*a* and 32*b*. As can be seen, termination sections 32*a* and 32*b* are bent nearly perpendicularly to the back end of the contact sections 31, and they extend practically at a right angle with respect to the surface of the contact section 31. In a rear portion of the contact section 31, press-in barbs 33 are provided for the purpose of retention of the contacts in the housing 50, and a rear-end section 34 is in the shape of a tab. At a front end of the contact section 31, hooks 35 are provided. As can be seen from FIGS. 18 and 10, the hooks 35 are narrower that the contact sections 31, and as depicted in FIGS. 7 and 9, they are offset from the plane of the contact section 31**.

As can be seen from FIG. 7, termination section **32*a* of the electrical contact 30*a* extends as a practically straight-line continuation of the contact section 31. The termination 32*a* includes a flat plate section 36 and a soldering termination member or tine 37 extending rearwardly from a board proximate edge of plate section 36. As also shown in FIG. 7, the plate section 36 has a lug or rib 38 extending outwardly from a board-remote edge thereof, preferably with tine 37 and rib 38 disposed in a common plane with plate section 36**.

Figure 4:
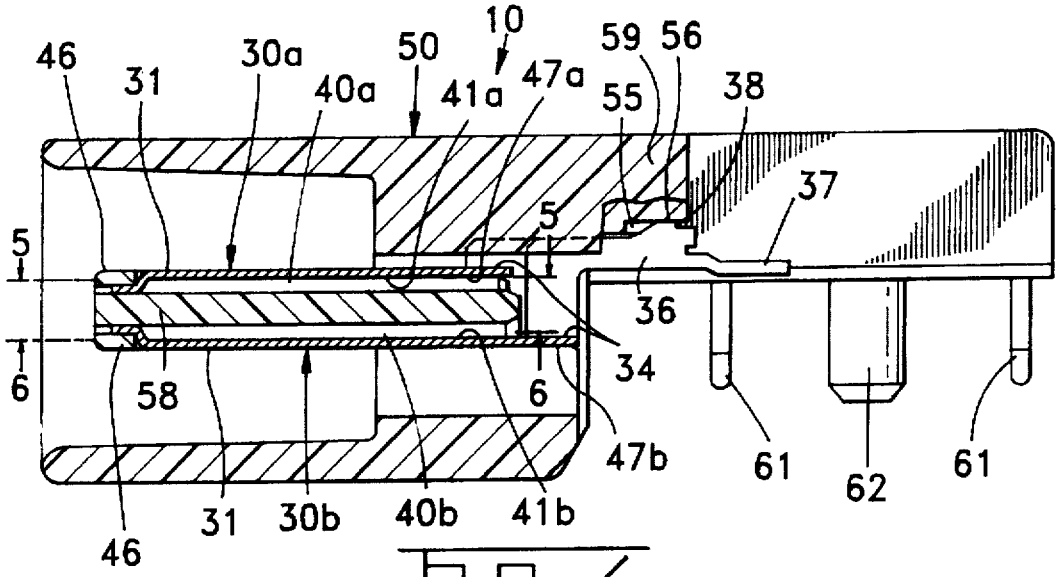
FIG. 4 is a cross-sectional view of FIG. 2 taken along line 4—4 thereof with the electrical connector being in an upright position.
Figure 11:
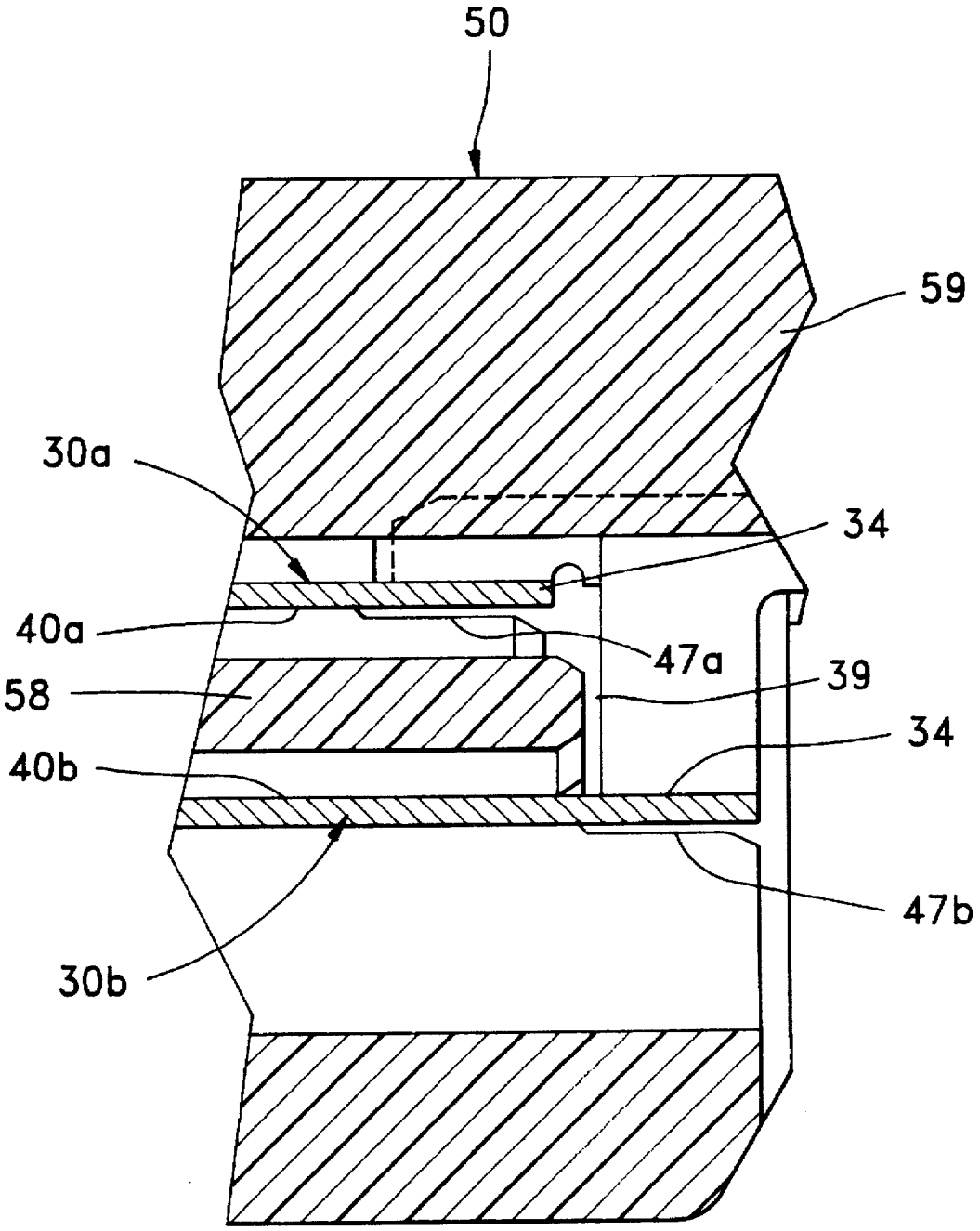
FIG. 11 is an enlarged part cross-sectional view of FIG. 4.

As can be seen from FIG. 9, termination section **32*b* of the electrical contact 30*b* has an intermediate piece 39 which is perpendicular to the contact section 31 so that when contacts 30*b* are inserted into the cavities in the housing 50, the soldering termination members 37 thereof are aligned with the soldering termination members 37 of contacts 30*a* (see FIGS. 4 and 11). Its extension has a plate section 36, soldering termination member 37 and a lug 38 which are similar to the same elements of the electrical contact 30*a***.

Figure 5:
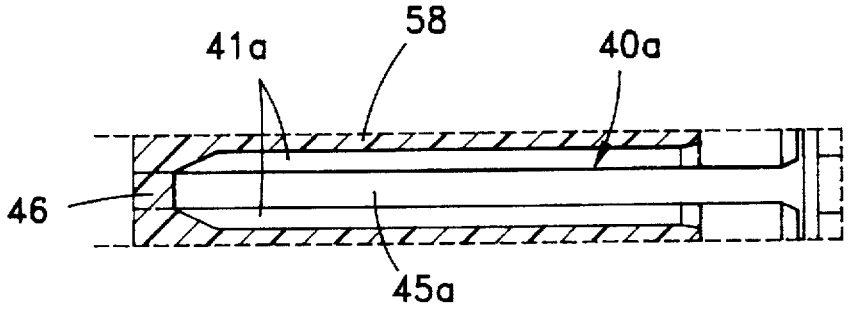
FIG. 5 is a cross-sectional view taken along line 5—5 of FIG. 4.
Figure 6:
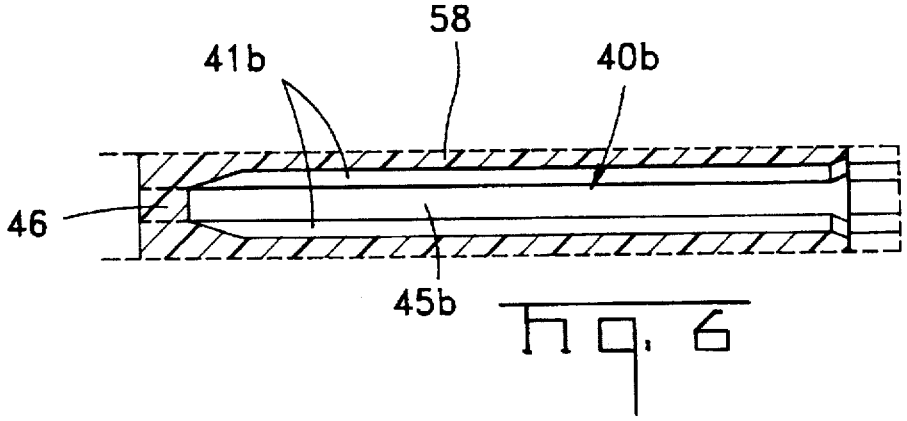
FIG. 6 is a cross-sectional view taken along line 6—6 of FIG. 4.
Figure 7:
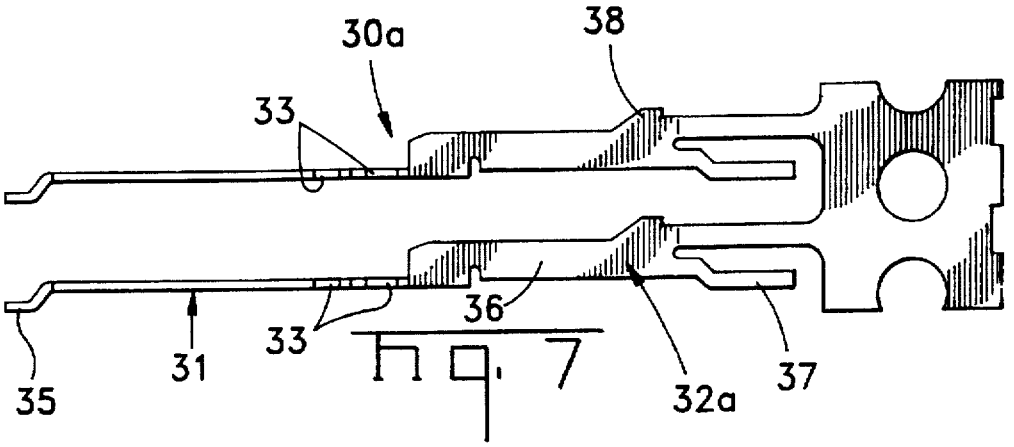
Figure 8:
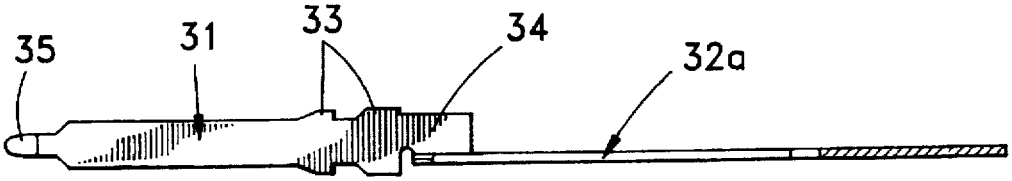
FIG. 8 is a partly-sectioned top view of FIG. 7.

As shown in FIG. 4, the housing 50 has a number of cavities **40*a* and 40*b* along upper and lower surfaces of a central section 58 in which two types of electrical contacts 30*a* and 30*b* are arranged in rows situated one above the other. Electrical contacts 30*a* are arranged in the upper row cavities 40*a*, and electrical contacts 30*b* are arranged in the lower row cavities 40*b*. The design of the connector is such that when electrical contacts 30*a* and 30*b* are placed in the cavities 40*a* and 40*b* of the housing 50, all soldering termination members 37 are arrayed in a straight line. It can be seen that contact sections 31 of lower row contacts 30*b* are disposed forwardly of a board-receiving region and aligned with a board 5 after connector 10 is mounted thereto. Intermediate pieces 39 of lower row contacts 30*b* are transverse to define a vertical offset to position the solder tines 37 of lower row contacts 30*b* above the board-receiving region to be above the respective contact pads of board 5. In addition, the surfaces of the contact sections 31 of electrical contacts 30*a* and 30*b* are facing out so that the contacts can engage with the contacts of a matable connector. During connection with a matable connector, at least a portion of the contact sections is supported by inside walls 41*a* and 41*b* of the cavities 40*a*, 40*b*** (see FIGS. 5 and 6).

When electrical contacts **30*a*, 30*b* are inserted and arranged in the housing 50, hooks 35 perform the role of guiding tips for the contact sections 31**.

In addition, guiding grooves **45*a* and 45*b* are provided with a wall 46 at an outer end of central section 58. As can be seen from FIG. 4, the engagement of hooks 35 within slots in walls 46 prevents the electrical contacts 30*a* and 30*b* from moving out of the cavities 40*a* and 40*b*** when the contacts are fully inserted.

At the back end of the cavities **40*a* and 40*b*, cut-outs 47*a* and 47*b* are provided (see FIG. 11). These cut-outs 47*a* and 47*b* make it possible for the tab-shaped rearward end sections 34 of the contact sections 31** to be bent within the limits of elastic deformation.

As can be seen from FIG. 4, the upper housing wall includes a rearwardly-extending section 59 that is spaced vertically upwardly of the board-receiving region, and below which are plate sections 36 of all contacts **30*a*, 30*b*. Multiple grooves 55 are made into the lower surface of upper wall section 59 of the connecting section 53 of the housing 50 which form a comb-like structure. As shown in FIG. 4, grooves 55 are dimensioned in such a manner that they envelope plate sections 36 of the electrical contacts 30*a* and 30*b*. From FIG. 4, it can be seen that when the electrical contacts 30*a* and 30*b* are completely inserted in the grooves 55, lugs 38 of the electrical contacts 30*a* and 30*b* engage against the bottom surface 56 of the grooves 55. As indicated above, since the rear portion 34 of the contact section can be bent within the limits of elastic deformation, the plate sections 36 of the termination sections 32***a* and 32*b* can be moved in the direction of the plane of the contact section. Therefore, the bottom surfaces 56 of the grooves 55 can serve as a reference plane for the termination sections 32*a* and 32*b*. As a result of this, the soldering termination members 37 can be aligned in a straight line, thus ensuring their coplanarity. In such a condition, the plate sections 36 contained in their respective grooves 55 are prevented from deformation which makes it possible to reliably ensure the position of the soldering termination members 37.

The above explanation concerning the connector of this invention has been given as an example only, but it is to be assumed that the claims include also various changes and modifications which can be made by experts in the art.

In a surface mount connector according to this invention, soldering termination members of multiple electrical contacts are arrayed perpendicularly to contact pads on a surface of a printed circuit board and arrayed in a straight line using a housing surface as a reference plane. Therefore, the electrical contacts can be arranged at a narrow pitch, while the soldering termination members are distinguished by an excellent coplanarity, which makes it possible to eliminate defects in soldering caused by poor application of the soldering termination members to the pads.

In addition, since the possibility of deformation of plate sections of all electrical contacts is eliminated due to the fact that they are retained in the grooves of a comb-like structure of the housing, coplanarity of the soldering termination members is reliably secured.

What is claimed is:

1. An electrical connector comprising:

an insulating housing having cavities arranged in at least one row and grooves therein, each of said grooves being associated with a respective one of said cavities and arranged normal thereto;

electrical contacts having flat contact sections disposed along said cavities and flat termination sections perpendicular to said contact sections extending along said grooves; and lugs on said termination sections engaging inner surfaces of said grooves thereby arraying said termination sections in a straight line so that soldering termination members of said termination sections are in alignment along a plane parallel to a plane contacting said contact sections, and cutouts are located at a back end of said cavities in which rearward end sections of the contact sections are disposed thereby enabling said rearward end sections to be bent thereinto within the limits of the elastic deformation thereof.

2. A surface mount electrical connector to be mounted on an edge of a circuit board formed with conductive pads therealong on a mounting surface, comprising;

a housing having a board support portion to be supported on the edge of the circuit board situated in a board-receiving region, and a mating portion extending beyond the edge of the circuit board, and a plurality of cavities extending forwardly from said board-receiving region; and a plurality of electrical contacts retained at a retention section in respective said cavities, each said contact having a generally flat contact portion parallel to the mounting surface of the circuit board and a plate portion rearwardly of said retention section and perpendicular to said contact portion and said mounting surface, a solder tine extending from said plate portion along said board-receiving region parallel to and slightly beyond a board-proximate edge of said plate portion and having an edge to engage the surface of the circuit board, said housing including an upper wall section extending rearwardly above said board-receiving region, each said plate portion extending along a support surface of said upper wall section with a rib formed near said solder tine to extend from a board-remote edge of said plate portion to abut against said support surface, whereby board-engaging edges of said solder tines are coaligned when urged against the mounting surface of the circuit board.

3. An electrical connector as set forth in claim 2 wherein said housing has a central section along which said cavities extend.

4. An electrical connector as set forth in claim 3 wherein said central section has walls at an outer end thereof, said walls have slots in which hooks of the contact sections are disposed.

5. An electrical connector as set forth in claim 3 wherein cutouts are located at a back end of said cavities in which rearward end sections of the contact sections rearwardly of said retention sections, are disposed thereby enabling said rearward end sections to be bent thereinto within the limits of the elastic deformation thereof.

6. An electrical connector as set forth in claim 3 wherein said cavities extend along top and bottom surfaces of said central section and having first and second rows of said contacts disposed therein respectively.

7. An electrical connector as set forth in claim 6 wherein the central section is aligned with and forwardly of the edge of the circuit board upon connector mounting thereto, and plate sections of the contacts of the second row have an intermediate transverse piece so that the solder tines thereof are in alignment with the solder tines of the contacts of the first row.

8. An electrical contact for use in a surface mount electrical connector to be mounted at an edge of a circuit board, comprising:

a substantially flat contact portion extending in a longitudinal direction;

a plate portion coupled to one end of said contact portion and extending along said longitudinal direction, said plate portion being substantially perpendicular to said contact portion;

a retention section located on one of said contact portion at a rearward end thereof, and said plate portion adjacent said contact portion, for retention of said contact in a housing passageway;

a relatively narrow solder tine formed at and extending from one edge of said plate portion at an end remote from said contact portion;

a rib formed remote from said retention section and adjacent said one edge and along an edge of said plate portion opposed to said solder tine, said rib having a dimension to abut against a wall in a housing of the electrical connector, said rib and said solder tine defined in a common plane with said plate section, with said solder tine being slightly offset from one edge of said plate portion for soldering to a conductive pad of the circuit board.

9. The contact as set forth in claim 8 wherein widened portions are defined along edges of said contact portion forwardly of said plate portion, cooperable with housing cavity side walls to provide contact retention within a housing forwardly of said plate portion.

10. The contact as set forth in claim 9 wherein said widened portions are spaced forwardly of said plate portion such that a rearward end section of said contact section is defined between said widened portions and said plate portion enabling incremental deflection thereat during contact assembly into a housing.

* * * * *